US007164232B2

(12) United States Patent
Brates et al.

(10) Patent No.: US 7,164,232 B2
(45) Date of Patent: Jan. 16, 2007

(54) SEAL FOR CERAMIC DISCHARGE LAMP ARC TUBE

(75) Inventors: Nanu Brates, Winchester, MA (US); Huiling Zhu, Lexington, MA (US); Jakob Maya, Brookline, MA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/883,870

(22) Filed: Jul. 2, 2004

(65) Prior Publication Data

US 2006/0001380 A1 Jan. 5, 2006

(51) Int. Cl.
*H01J 17/18* (2006.01)

(52) U.S. Cl. ..... 313/624; 313/625

(58) Field of Classification Search ..... 313/623–628, 313/631, 574, 634
See application file for complete search history.

(56) References Cited

U.S. PATENT DOCUMENTS

| | | | | |
|---|---|---|---|---|
| 6,137,228 | A * | 10/2000 | Aizawa et al. | 313/631 |
| 6,181,065 | B1 | 1/2001 | Huettinger et al. | |
| 6,249,086 | B1 * | 6/2001 | Honda et al. | 313/631 |
| 6,300,716 | B1 * | 10/2001 | Honda | 315/51 |
| 6,392,345 | B1 | 5/2002 | Niimi et al. | |
| 6,414,451 | B1 | 7/2002 | Baake et al. | |
| 6,495,959 | B1 | 12/2002 | Ikeuchi et al. | |
| 6,495,960 | B1 * | 12/2002 | Takeji et al. | 313/634 |
| 6,621,219 | B1 * | 9/2003 | Allen et al. | 313/623 |
| 6,661,176 | B1 * | 12/2003 | Honda et al. | 315/56 |
| 6,713,962 | B1 * | 3/2004 | Nohara et al. | 313/623 |
| 6,724,144 | B1 * | 4/2004 | Takeji et al. | 313/634 |
| 6,819,050 | B1 * | 11/2004 | Zhu et al. | 313/639 |
| 6,856,079 | B1 * | 2/2005 | Zhu | 313/326 |
| 2003/0234612 | A1 * | 12/2003 | Kelly et al. | 313/623 |
| 2005/0052139 | A1 * | 3/2005 | Anami et al. | 313/620 |

FOREIGN PATENT DOCUMENTS

| | | |
|---|---|---|
| JP | 2003142033 | 5/2003 |

* cited by examiner

*Primary Examiner*—Nimeshkumar D. Patel
*Assistant Examiner*—Dalei Dong
(74) *Attorney, Agent, or Firm*—Kinney & Lange, P.A.

(57) ABSTRACT

An arc discharge metal halide lamp having a discharge chamber with visible light permeable walls bounding a discharge region through which walls a pair of electrode assemblies are supported with interior ends thereof positioned in the discharge region spaced apart from one another. These electrode assemblies each also extend through a corresponding capillary tube affixed to the walls to have exterior ends thereof positioned outside the arc discharge chamber. At least one of these electrode assemblies comprises an electrode discharge structure with a discharge region shaft extending into the capillary tube corresponding thereto. A discharge region shaft extends outwardly in that corresponding capillary tube to be in direct contact with an interconnection shaft extending outside of that corresponding capillary tube to provide an exterior end of this electrode assembly, and which is in direct contact with a sealing cap over the end of the tube.

20 Claims, 8 Drawing Sheets

SEAL FOR CERAMIC DISCHARGE LAMP ARC TUBE

BACKGROUND OF THE INVENTION

This invention relates to high intensity arc discharge lamps and more particularly to high intensity arc discharge metal halide lamps having high efficacy.

Due to the ever-increasing need for energy conserving lighting systems that are used for interior and exterior lighting, lamps with increasing lamp efficacy are being developed for general lighting applications. Thus, for instance, arc discharge metal halide lamps are being more and more widely used for interior and exterior lighting. Such lamps are well known and include a light transmissive arc discharge chamber sealed about an enclosed a pair of spaced apart electrodes, and typically further contain suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation.

These lamps typically have a ceramic material arc discharge chamber bounding a discharge region that usually contains quantities of metal halides such as $CeI_3$ and NaI, (or $PrI_3$ and NaI) and T1I, as well as mercury to provide an adequate voltage drop or loading between the electrodes, and also an inert low ionization potential starting gas. A pair of electrodes is arranged on opposite ends of the discharge tube extending from outside the tube into the discharge region to allow electrical energization to occur in that region. Such lamps can have an efficacy as high as 145 LPW at 250 W with a Color Rendering Index (CRI) higher than 60, and with a Correlated Color Temperature (CCT) between 3000K and 6000K at 250 W.

Referring to FIG. 1 in describing such a lamp in more detail, a typical arc discharge metal halide lamp, 10, known in the prior art is shown in a side view having a bulbous, transparent borosilicate glass envelope, 11, fitted into a conventional Edison-type metal base, 12. Lead-in, or electrical access, electrode wires, 14 and 15, of nickel or soft steel, each extend from a corresponding one of the two electrically isolated electrode metal portions in base 12 parallely through and past a borosilicate glass flare, 16, positioned at the location of base 12 and extending into the interior of envelope 11 along the axis of the major length extent of that envelope. Electrical access wires 14 and 15 extend initially on either side of, and in a direction parallel to, the envelope length axis past flare 16 to have portions thereof located further into the interior of envelope 11 with access wire 15 extending after some bending into a borosilicate glass dimple, 16', at the opposite end of envelope 11. Electrical access wire 14 is provided with a second section in the interior of envelope 11, extending at an angle to the first section that parallels the envelope length axis, by having this second section welded at such an angle to the first section so that it ends after more or less crossing the envelope length axis.

Some remaining portion of access wire 15 in the interior of envelope 11 is bent at an obtuse angle away from the initial direction thereof parallel to the envelope length axis. Access wire 15 with this first bend therein past flare 16 directing it away from the envelope length axis, is bent again to have the next portion thereof extend substantially parallel that axis, and further along bent again at a right angle to have the succeeding portion thereof extend substantially perpendicular to, and more or less cross that axis near the other end of envelope 11 opposite that end thereof fitted into base 12. The succeeding portion of wire 15 parallel to the envelope length axis supports a conventional getter, 19, to capture gaseous impurities. Three additional right angle bends are provided further along in wire 15 to thereby place a short remaining end portion of that wire below and parallel to the portion thereof originally described as crossing the envelope length axis which short end portion is finally anchored at this far end of envelope 11 from base 12 in glass dimple 16'.

A ceramic arc discharge chamber, 20, configured about a bounded or contained region as a shell structure having polycrystalline alumina walls that are translucent to visible light, is shown in one of various possible geometric configurations in FIG. 1. Alternatively, the walls of arc discharge chamber 20 could be formed of aluminum nitride, yttria ($Y_2O_3$), sapphire ($Al_2O_3$), or some combinations thereof. Discharge chamber 20 is provided in the interior of envelope 11 which interior can otherwise either be evacuated, to thereby reduce the heat transmitted to the envelope from the chamber, or can instead be provided with an inert gaseous atmosphere such as nitrogen at a pressure greater than 300 Torr to thereby increase that heat transmission if operating the chamber at a lower temperature is desired. The region enclosed in arc discharge chamber 20 contains various ionizable materials, including metal halides and mercury, which emit light during lamp operation and a starting gas such as the noble gases argon (Ar), xenon (Xe) or neon (Ne) or some mixture thereof.

In this structure for arc discharge chamber 20, as better seen in the cross section view thereof in FIG. 2, a pair of polycrystalline alumina, relatively small inner and outer diameter truncated cylindrical shell portions, or capillary tubes, 21*a* and 21*b*, are each concentrically joined to a corresponding one of a pair of polycrystalline alumina end closing disks, 22*a* and 22*b*, about a centered hole therethrough so that an open passageway extends through each capillary tube and through the hole in the disk to which it is joined. These end closing disks are each joined to a corresponding end of a polycrystalline alumina tube, 25, formed as a relatively large diameter truncated cylindrical shell with the inner diameter thereof designated as D, so as together to be about the enclosed region in providing the primary arc discharge chamber. The total length of the enclosed space in chamber 20 extends between the junctures of tubes 21*a* and 21*b* with the corresponding one of closing end disks 22*a* and 22*b*. The length of primary central portion chamber structure 25 of chamber 20 extends between the junctures therewith and each of closing end disks 22*a* and 22*b*. These various portions of arc discharge tube 20 are formed by compacting alumina powder into the desired shape followed by an initial sintering of the resulting compact to thereby provide the preformed portions, and the various preformed portions are joined together by a final sintering to result in a preformed single body of the desired dimensions having walls impervious to the flow of gases.

Chamber electrode interconnection wires, 26*a* and 26*b*, of niobium each extend out of a corresponding one of tubes 21*a* and 21*b* to reach and be attached by welding to, respectively, access wire 14 at its end portion crossing the envelope length axis and to access wire 15 at its portion first described as crossing the envelope length axis. This arrangement results in chamber 20 being positioned and supported between these portions of access wires 14 and 15 so that its long dimension axis approximately coincides with the envelope length axis, and further allows electrical power to be provided through access wires 14 and 15 to chamber 20.

FIG. 2 shows the discharge region contained within the bounding walls of arc discharge chamber 20 that are provided by structure 25, disks 22*a* and 22*b*, and tubes 21*a* and 21*b* of FIGS. 1 and 2, and shows in cross section view the electrode arrangements having capillary tubes 21*a* and 21*b* and the corresponding electrodes extending therethrough into the discharge region in greater detail. Chamber electrode interconnection wire 26*a*, being of niobium, has a thermal expansion characteristic that relatively closely matches that of tube 21*a* and that of a glass frit, 27*a*, affixing wire 26*a* to the inner surface of tube 21*a* (and hermetically sealing that interconnection wire opening with wire 26*a* passing therethrough) but cannot withstand the chemical attack resulting from the forming of a plasma in the main volume of chamber 20 during operation. Thus, a tube or wrapped foil of niobium, 28*a*, is used to connect a cermet lead-through rod, 29*a*, which can withstand operation in the plasma, to one end of interconnection wire 26*a* by welding where this end is also surrounded by a portion of frit 27*a* in a hermetic seal. The other end of lead-through rod 29*a* has one end of a tungsten main electrode shaft, 31*a*, positioned thereagainst and connected thereto by laser welding.

In addition, a tungsten electrode coil, 32*a*, is integrated and mounted to the tip portion of the other end of first main electrode shaft 31*a* by press fitting, so that an electrode, 33*a*, is configured by main electrode shaft 31*a* and electrode coil 32*a*. Electrode 33*a* is formed of tungsten for good thermionic emission of electrons while withstanding relatively well the chemical attack of the metal halide plasma. Lead-through rod 29*a* serves to dispose electrode 33*a* at a predetermined position in the region contained in the main volume of arc discharge chamber 20. This configuration results in lower temperatures in the sealing regions in capillary tube 21*a* during lamp operation since electrode 33*a*, in extending through this capillary tube into the chamber discharge region a significant distance, is thereby spaced further from the seal region in capillary tube 21*a* as is then the discharge arc established between this and the opposite end electrode during operation.

A portion of first main electrode shaft 31*a* is spaced from tube 21*a* by a molybdenum coil, 34*a*, having one end thereof welded to the interior end of cermet rod 29*a* that is positioned in frit 27*a*. Since tungsten rod 31*a* with electrode coil 32*a* mounted thereon to form electrode 33*a* must be placed in the corresponding end of capillary tube 21*a* and then positioned to extend into the discharge region in arc discharge chamber 20*a* selected distance after the fabrication of that chamber has been completed, the inner diameter of capillary tube 21*a* must have inner diameters exceeding the outer diameter of the electrode coil 32*a*. As a result, there is a substantial annular space between the outer surface of tungsten rod 31*a* and the inner surfaces of capillary tube 21*a* which must be taken up in part by the provision of molybdenum coil 34*a* around and against the corresponding portion of tungsten rod 31*a* to complete the interconnections thereof and reduce the condensation in these regions of the metal halide salts occurring in chamber 20 during lamp operation. A typical diameter for both interconnection wire 26*a* and cermet rod 29*a* is 0.9 mm, and a typical diameter of electrode shaft 31*a* is 0.5 mm.

Similarly, in FIG. 2, chamber electrode interconnection wire 26*b* is affixed by a glass frit, 27*b*, to the inner surface of tube 21*b* (and hermetically sealing that interconnection wire opening with wire 26*b* passing therethrough). A niobium material tube or wrapped foil, 28*b*, is used to connect a cermet lead-through rod, 29*b*, to one end of interconnection wire 26*b* by welding where this end is also surrounded by a portion of frit 27*b* in a hermetic seal, and the other end of lead-through rod 29*b* has one end of a tungsten main electrode shaft, 31*b*, laser welded to it. A tungsten electrode coil, 32*b*, is integrated and mounted to the tip portion of the other end of the first main electrode shaft 31*b* by press fitting, so that an electrode, 33*b*, is configured by main electrode shaft 31*b* and electrode coil 32*b* which is disposed at a predetermined position in the discharge region of chamber 20 to thereby provide sufficiently lower temperatures in the corresponding seal region. A portion of second main electrode shaft 31*b* is spaced from tube 21*b* by a molybdenum coil, 34*b*, connected by welding to the interior end of cermet rod 29*b* and fills in part the resulting annular space therebetween needed to allow electrode 33*b* to pass, the outer end of that coil also being in frit 27*b*. A typical diameter for both interconnection wire 26*b* and cermet rod 29*b* is also 0.9 mm, and a typical diameter of electrode shaft 31*b* is again 0.5 mm.

These electrode arrangements have "compromise" properties components in the seal regions within capillary tubes 21*a* and 21*b*, these being outer electrode parts of cermet rods 29*a* and 29*b* which provide good thermal expansion matching to the polycrystalline alumina but which are expensive to manufacture. The exposure length of each of outer electrode portions 26*a* and 26*b* must be limited thus requiring the presence of the bridging middle part of the electrode arrangement, typically a cermet rod as above or possibly a molybdenum wire or rod, between such outer electrode portion and the corresponding tungsten electrode portion. Special welding techniques such as laser welding are necessary to join the ends of tungsten electrode rods 31*a* and 31*b* to the ends of cermet rods 29*a* and 29*b*, respectively. Furthermore, as a brittle materials cermet rods 29*a* and 29*b* cannot be resistance welded to outer lamp parts and so they are affixed to the corresponding ones of interconnection wires 26*a* and 26*b* with corresponding ones of niobium sleeves 28*a* and 28*b* by use of laser welding.

Care must also taken to ensure that the melted sealing frits 27*a* and 27*b* flow completely around and beyond the corresponding niobium rods to thereby form a protective surface over the niobium against the chemical reactions due to the halides preventing condensation of salts. The frit flow length inside the corresponding capillary tube needs to be controlled very precisely. If the frit length is short, the niobium rod portion of the electrode is exposed to chemical attack by the halides. If this length is excessive, the large thermal mismatch between the frit and the solid middle electrode portion molybdenum, tungsten or cermet rod following inward from the niobium rod leads to cracks in the sealing frit or polycrystalline alumina, or both, in that location.

In these circumstances, of course, other ceramic arc discharge chamber constructions for ceramic metal halide lamps that make use of different sealing methods or structural arrangements have been resorted to. These include methods such as direct sintering of polycrystalline alumina to the electrode arrangement, the use of cermets in and about electrode arrangements or substituting other alternative materials in such electrode arrangements, frit position limiters and graded temperature coefficient of expansion seals, or even the use of new arc tube materials that enable straight sealing of the tube body to a single material electrode such as molybdenum or tungsten.

However, these alternative methods have not yet been able to demonstrate an overall advantage with respect to improved lamp performance, lower cost, or compatibility with simpler lamp factory processes. Thus, a further alternative structural arrangement has been used in which a metal lid is welded to the electrode arrangement in an air-tight joint and a metal pipe or sleeve over the outside of the chamber capillary tube in which the electrode arrangement is positioned is sealed against this lid with a first melted and then resolidified frit seal. Such a configuration, however, prevents the escape of gases during formation of this frit seal leading to voids therein and increasing pressures that result in repositioning parts of the molten frit perhaps even violently. Thus, there is a desire to provide another sealed electrode structure for the arc discharge chamber that avoids cracks in some portion thereof due to thermal mismatches between materials and voids in sealing materials to thereby provide an more reliable structure at lower costs.

BRIEF SUMMARY OF THE INVENTION

The present invention provides an arc discharge metal halide lamp for use in selected lighting fixtures having a discharge chamber with visible light permeable walls bounding a discharge region through which walls a pair of electrode assemblies are supported with interior ends thereof positioned in the discharge region spaced apart from one another. These electrode assemblies each also extend through a corresponding capillary tube affixed to the walls to have exterior ends thereof positioned outside the arc discharge chamber. At least one of these electrode assemblies comprises an electrode discharge structure located at the interior end thereof, the electrode discharge structure having a discharge region shaft extending into the capillary tube corresponding thereto to be in electrical contact with an interconnection shaft either directly or through an intermediate connection with the interconnection shaft having a portion extending outside of that corresponding capillary tube to provide the exterior end of this electrode assembly which is in direct contact with a sealing cap provided over the end of the tube. Such an arrangement can also be provided for the other electrode assembly.

The interconnection shaft is sealed in the corresponding capillary tube with a sealing frit with this shaft either having the other end of a helical coil wound there about or being provided by an extended end of the helical coil. A spatial volume occupying structure can be used to reduce the amount needed of such frit.

DETAILED DESCRIPTION

In a typical arc discharge tube structure sufficient to form a reliable sealing of the electrode in each of the polycrystalline alumina material capillary tubes extending from the remainder of the polycrystalline alumina material arc discharge tube, each of the electrical conducting leads, the sealing frit and the polycrystalline alumina need to have similar thermal expansion coefficients to thereby reduce thermal stresses in the sealing regions of the arc discharge tube resulting from the large temperature increases occurring during lamp operation. The use of niobium metal cap assemblies in connection with each of the electrodes in these sealing regions will result in significantly lower thermal stresses therein over temperature changes as its thermal expansion coefficient is similar to that of polycrystalline alumina. Placing the niobium metal cap assembly outside the arc tube capillary can eliminate the possibility of chemical reaction between the niobium and metal halide fill materials.

Figure 3:
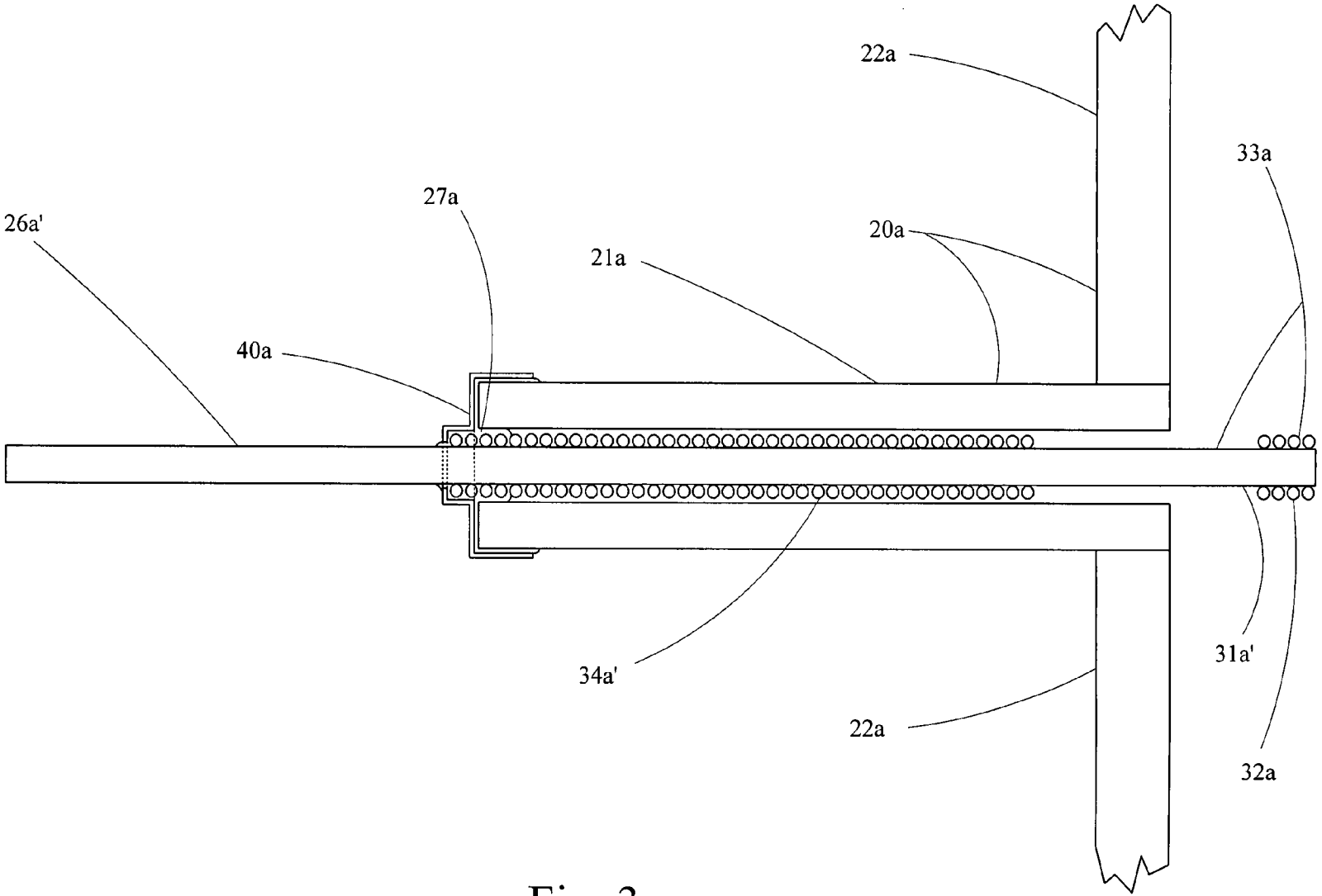
FIG. 3 shows a portion of an arc discharge chamber in cross section with an embodiment of the present invention.

One such cap assembly electrode arrangement is shown in FIG. 3 in a fragmentary view of a portion of arc discharge chamber 20 that includes capillary tube 21*a* with the associated electrode extending therethrough into the chamber discharge region to form an expanded partial cross section side view thereof. There, a molybdenum coil, 34*a*', is wound around an extended length tungsten rod, 31*a*', that extends from the discharge region of arc discharge chamber 20 through the full length of capillary tube 21*a*, and continues outside beyond the end tube of that tube with this outer portion serving as a chamber electrode interconnection wire, 26*a*'. Molybdenum coil 34*a*' also extends a few turns outside past the end of capillary tube 21*a* and the outside end of this coil is attached by crimping or spot welding to a niobium metal cap, 40*a*, so that cap 40*a* will form an external seal about the electrode provided by the coil and extended tungsten metal rod 31*a*' in sealing off the discharge region in arc discharge chamber 20. Affixing cap 40*a* to the end of molybdenum coil 34*a*' by crimping or spot welding serves to control the insertion length of the electrode into the discharge chamber. The use of a crimp or just a spot weld for this joining assures that an unsealed passageway is formed at this point in the sealing process elsewhere between cap 40*a* and extended tungsten metal rod 31*a*' to thereby allow gases to escape therethrough that are formed in the melting and resolidifying of frit 27*a*. Thus, in FIG. 3, a spot weld is shown with a concave curve representing the meniscus of the weld material on the lower side of chamber electrode interconnection wire 26*a*' at cap 40*a*.

Sealing frit 27*a* with a thermal expansion coefficient chosen to match that of polycrystalline alumina and niobium, at least at the operating temperature of arc discharge chamber 20, is used to complete this electrode seal by sealing the gap between polycrystalline alumina capillary tube 21*a* and cap 40*a*. Some excess frit resolidifies outside of cap 40*a* in the gas passageway space between it and chamber electrode interconnection wire 26*a*' at which the spot weld is absent as shown by the convex curve on the upper side of chamber electrode interconnection wire 26*a*' at cap 40*a*. Preventing reactions between the metal halide salts and cap 40*a* of niobium metal requires having sealing frit 27*a* distributed such that it conformably covers the inner surface of that cap. This glass frit also seals the gap or passageway between cap 40*a* and molybdenum coil 34*a*' of the electrode formed by this coil and tungsten metal rod 31*a*'. During the arc discharge chamber sealing process, melted frit 27*a* should flow inwardly in the interior channel of polycrystalline alumina capillary tube 21*a* from its outer end sufficiently to cover 2 to 4 turns of molybdenum coil 34*a*' as wrapped about extended tungsten rod 31*a*'. The coverage of the end of molybdenum coil 34*a*' will prevent metal halide salts from accumulating on the inner surface of cap 40*a* over the duration of lamp operation such that lamp performance will not change over time. The same electrode sealing arrangement can be provided at the other end of arc discharge chamber 20 in connection with capillary tube 21*b*.

Figure 4:
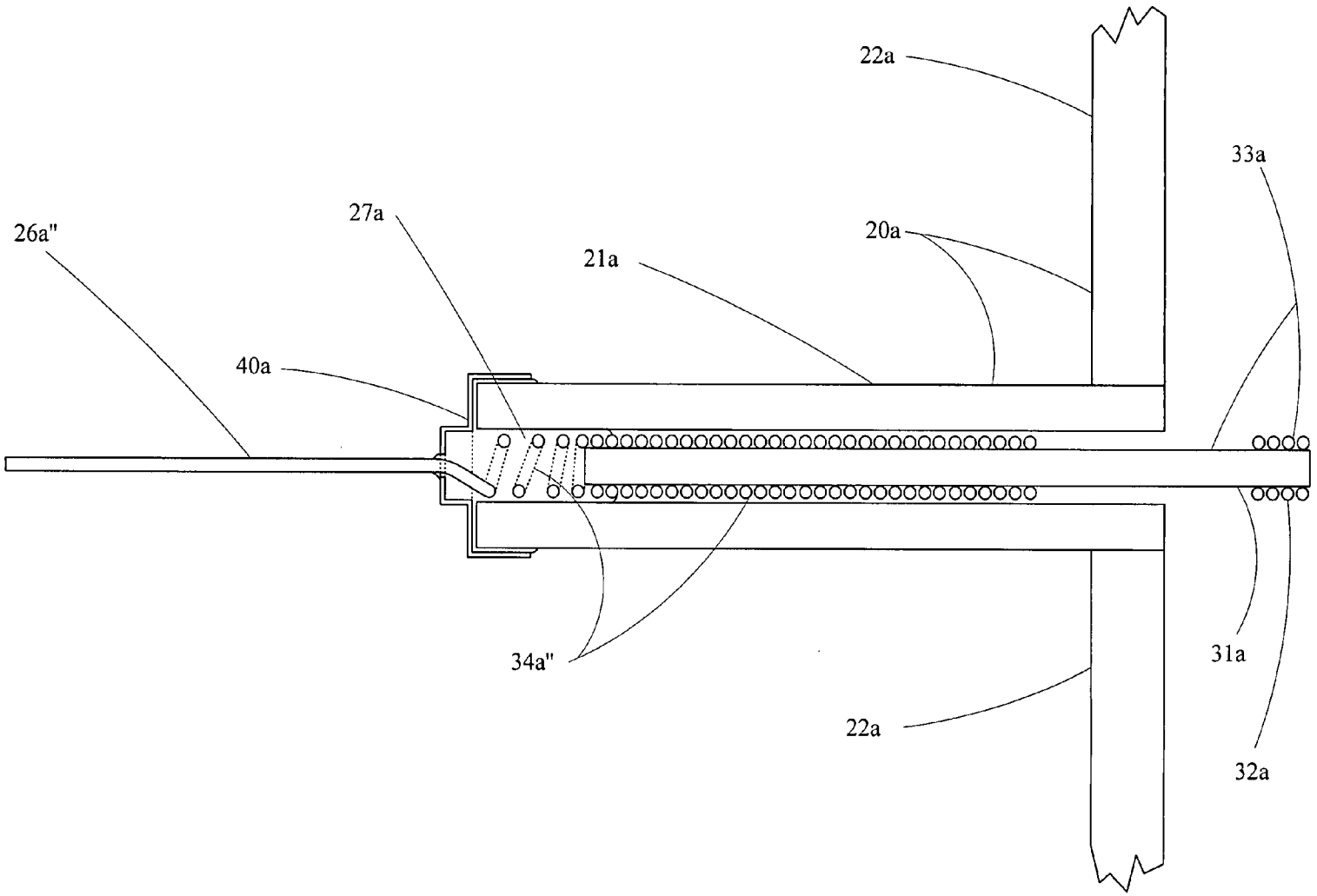
FIG. 4 shows a portion of an arc discharge chamber in cross section with an alternative embodiment of the present invention.

FIG. 4 shows, in a fragmentary partial cross section side view that includes capillary tube 21*a*, a further alternative embodiment of the present invention having a different electrode being used with the cap assembly. An extended length molybdenum coil, 34*a*41 , is wound around tungsten rod 31*a* and also stretched in the portion thereof near the outer end of capillary tube 21*a* and permanently deformed into an extended helical coil in that region. This helical coil portion of molybdenum coil 34*a*" is continued outside past the end of tube 21*a* a couple of turns after which it is straightened into an extended linear portion to form a chamber electrode interconnection wire, 26*a*". Approximately at the point the helical coil portion of molybdenum coil 34*a*" straightens into an extended linear portion, this coil, or wire 26*a*", is attached to niobium metal cap 40*a* by crimping or spot welding. Again, cap 40*a* will form an external seal about the electrode provided by the coil in sealing off the discharge region in arc discharge chamber 20, and again the use of a crimp or a spot weld avoids a seal all about wire 26*a*" at this point in the sealing process so that a passageway is formed this time between the cap 40*a* and this linear portion of molybdenum coil 34*a*".

Sealing frit 27*a* with a thermal expansion coefficient chosen to match that of polycrystalline alumina and niobium, at least at the operating temperature of arc discharge chamber 20, is again used to complete this electrode seal by sealing the gap between polycrystalline alumina capillary tube 21 a and cap 40*a*. As before, preventing reactions between the metal halide salts and the cap 40*a* of niobium metal requires having sealing frit 27*a* distributed such that it conformably covers the inner surface of that cap. This glass frit also seals the gap or passageway between cap 40*a* and linear wire 26*a*" of the electrode formed by this coil and its extended linear portion. During the arc discharge chamber sealing process, frit 27*a* should flow in the interior polycrystalline alumina capillary tube 21*a* inwardly from its outer end sufficiently to cover 2 to 4 turns of molybdenum coil 34*a*" as wrapped about extended tungsten rod 31*a* so as to also cover the end of that rod to again prevent metal halide salts from accumulating on the inner surface of cap 40*a* over the duration of lamp operation. Here, too, this same electrode sealing arrangement can be provided at the other end of arc discharge chamber 20 in connection with capillary tube 21*b*.

Figure 5:
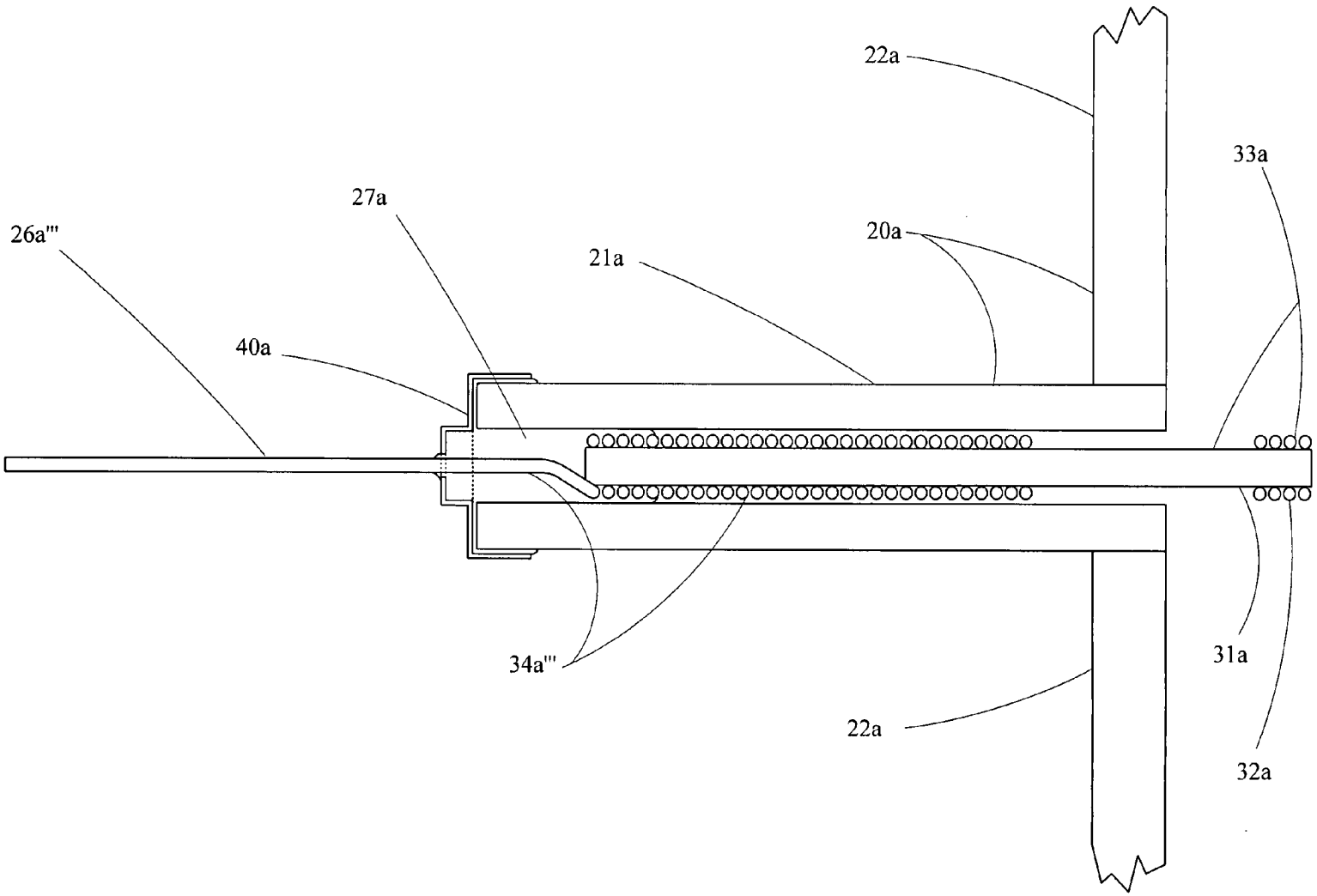
FIG. 5 shows a portion of an arc discharge chamber in cross section with an alternative embodiment of the present invention.

FIG. 5, in another fragmentary partial cross section side view that includes capillary tube 21*a*, shows another embodiment with an electrode arrangement similar to that shown in FIG. 4 but with the omission of a stretched helical coil portion which is replaced by a longer linear extension. A molybdenum coil, 34*a*'", again has an interior end portion thereof wound about an outer end portion of tungsten rod 31*a* but this coil has its outer end portion straightened into a linearly extending portion that begins well within the interior of capillary tube 21*a* and continues outside that tube past the end thereof as a chamber electrode interconnection wire, 26*a*'". Interconnection wire 26*a*'" is affixed to niobium metal cap 40*a* again by crimping or spot welding to thereby leave a passageway between them preparatory to cap 40*a* forming an external seal about the electrode provided by the coil linear extension in sealing off the discharge region in arc discharge chamber 20. Sealing frit 27*a* completes the seal as before just as for the seal shown in FIG. 4, and the opposite end of the chamber with capillary tube 21*b* can be configured with the same electrode arrangement as shown in FIG. 5.

Figure 1:
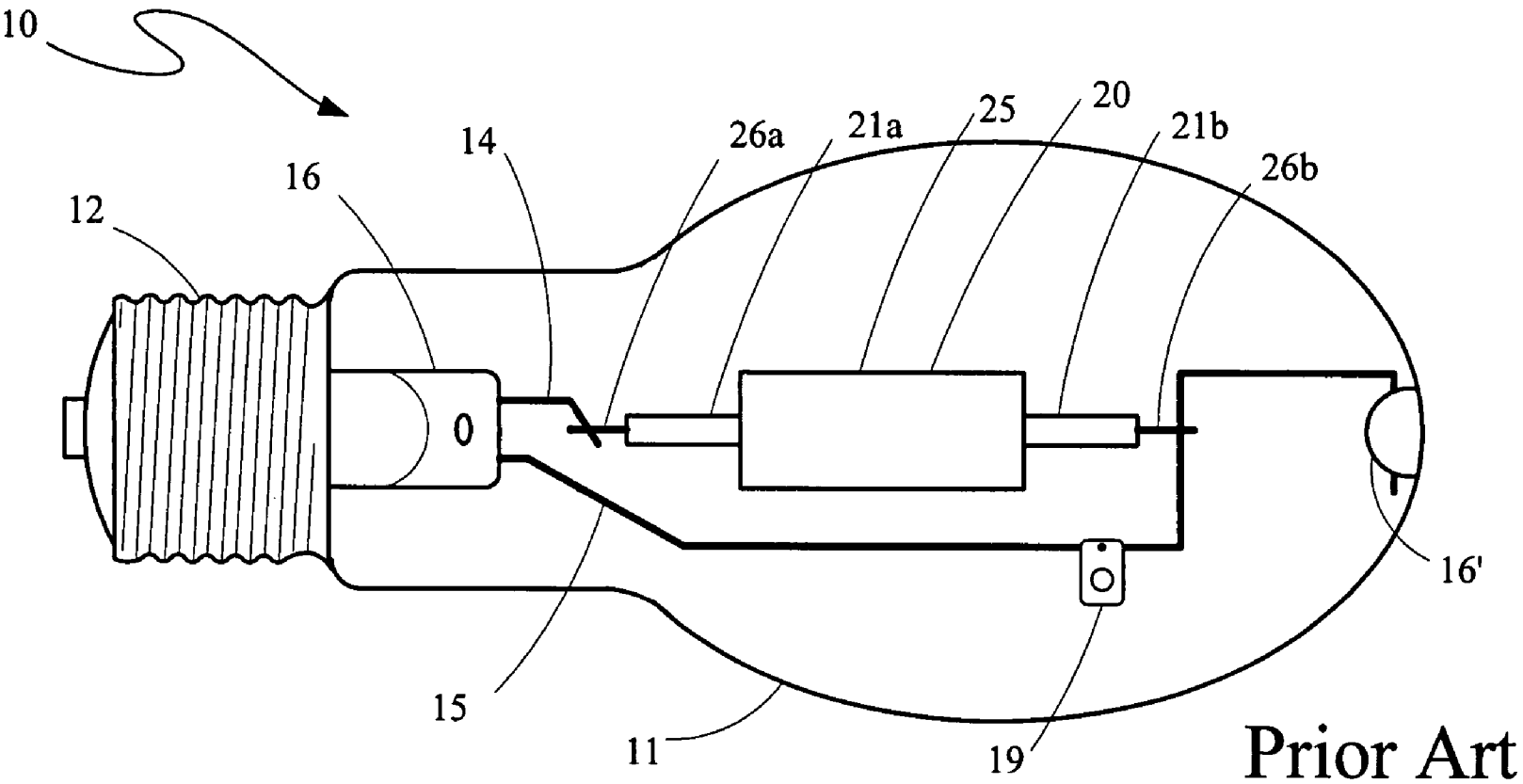
Prior Art Fig. 1
FIG. 1 is a side view, partially in cross section, of an arc discharge metal halide lamp of the present invention having a ceramic arc discharge chamber of a selected configuration therein.
Figure 2:
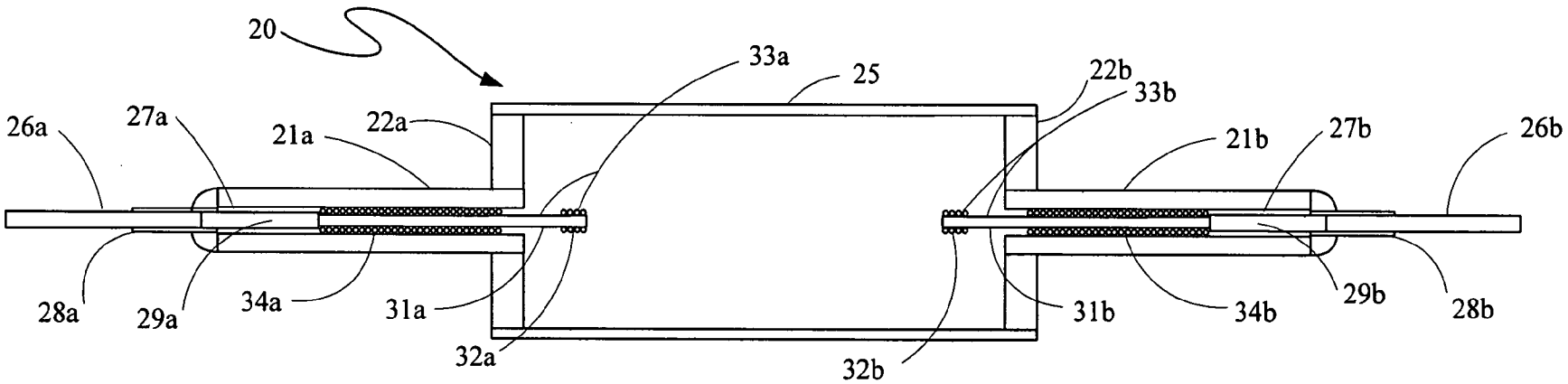
Prior Art Fig. 2
FIG. 2 shows a known arc discharge chamber for the arc discharge chamber of FIG. 1 in cross section in an expanded view.
Figure 6:
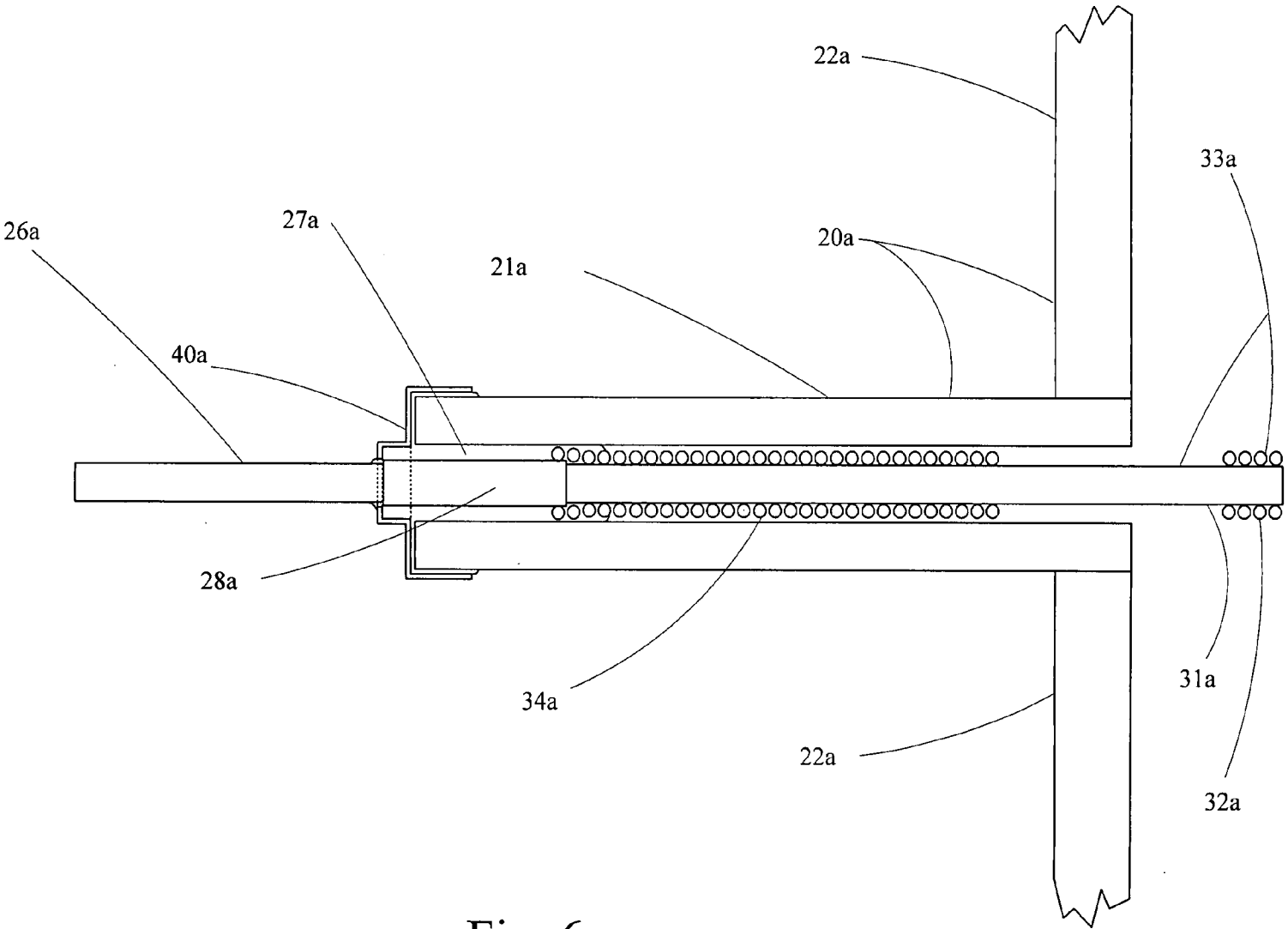
FIG. 6 shows a portion of an arc discharge chamber in cross section with an alternative embodiment of the present invention.

FIG. 6 shows yet a further fragmentary partial cross section side view that includes capillary tube 21*a* with an electrode embodiment substituting a wrapped foil for the longer linear extension coil portion in the electrode shown in FIG. 5. Molybdenum coil 34*a* of FIG. 1 is essentially again used with its interior end portion wound about an outer end portion of tungsten rod 31*a*, and with the outer end portion thereof welded to niobium tube or wrapped foil 28*a*. Tube or foil 28*a* begins well within the interior of capillary tube 21*a* and continues outside that tube past the end thereof where it is spot welded to niobium metal chamber electrode interconnection wire 26*a* and to niobium metal cap 40*a* to thereby leave a passageway between them preparatory to cap 40*a* forming an external seal about the electrode provided by foil 28*a* and wire 26*a* in sealing off the discharge region in arc discharge chamber 20. Sealing frit 27*a* completes the seal as before just as for the seal shown in FIG. 5, and the opposite end of the chamber with capillary tube 21*b* can be configured with the same electrode arrangement as shown in FIG. 6.

Figure 7:
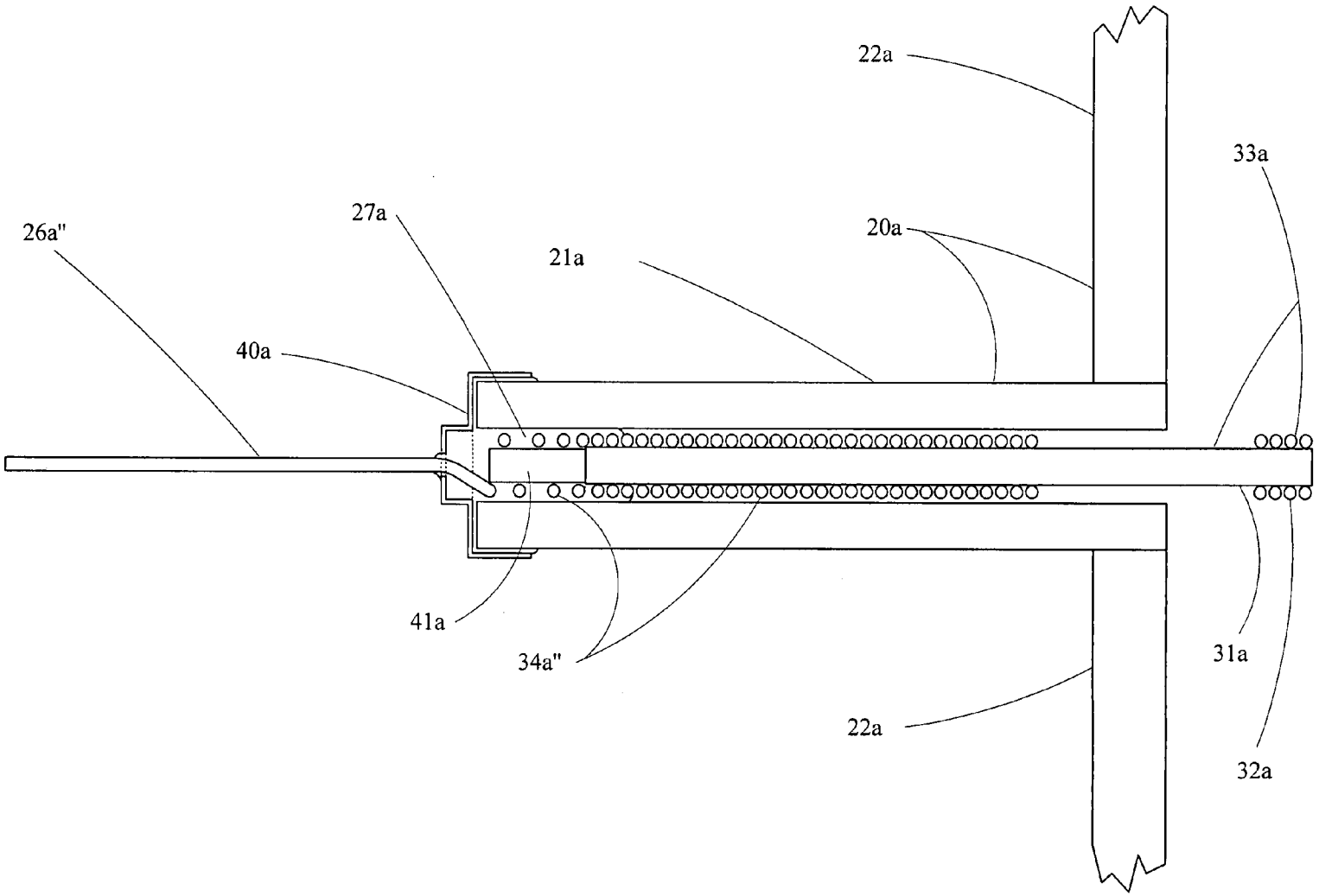
FIG. 7 shows a portion of an arc discharge chamber in cross section with an alternative embodiment of the present invention.

FIG. 7 shows the fragmentary partial cross section side view of the embodiment of FIG. 4 with a solid polycrystalline alumina rod, 41*a*, inserted within the helical coil portion stretched from molybdenum coil 34*a*". Rod 41*a* thus has a diameter smaller than the inner diameter of this helical coil portion which from the coil of FIG. 1 will typically be between 0.4 and 0.5 mm. Since the helical coil portion occurs in the sealing region provided by resolidified frit 27*a*, the addition of polycrystalline alumina rod 41*a* reduces the volume of this sealing frit If a relatively large volume of sealing frit is provided in the sealing region, some voids in the form of spherical cavities can occur during arc discharge chamber capillary tube sealing processes which is thus alleviated by the presence of rod 41*a*. Rod 41*a* should not be tightly fitted into the interior region of the helical coil portion of molybdenum coil 34*a*" so that frit 27*a* can bond to this molybdenum helical coil over all of its surface areas including in the gap between the helical coil and rod 41*a*.

Figure 8:
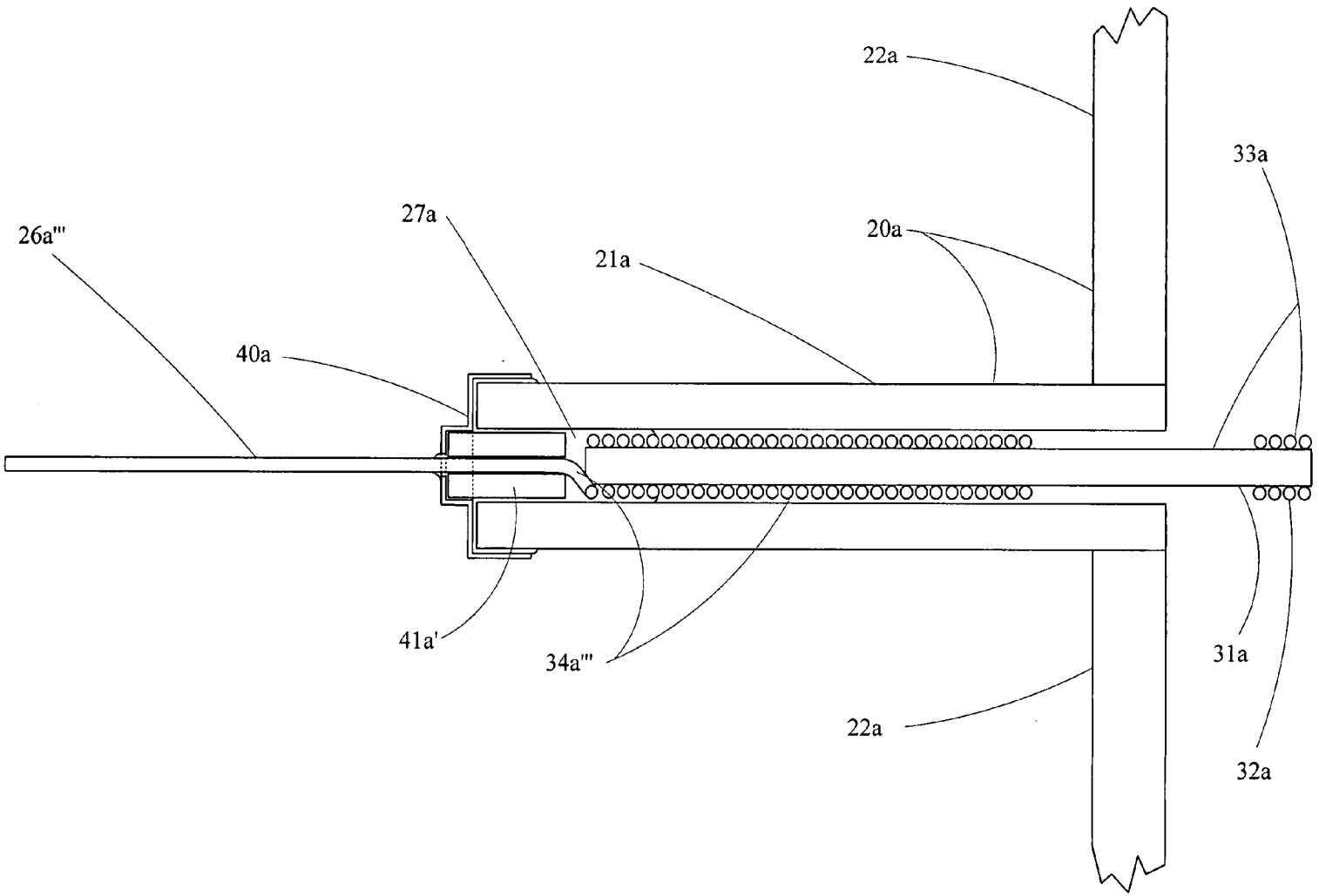
FIG. 8 shows a portion of an arc discharge chamber in cross section with an alternative embodiment of the present invention.

FIG. 8 shows the fragmentary partial cross section side view of the embodiment of FIG. 5 with a polycrystalline alumina sleeve, 41*a*", positioned about the linear extension portion of molybdenum coil 34*a*'". In keeping with molybdenum coil 34*a* of FIG. 1, sleeve 41*a*' has an outer diameter of 1.0 mm, an inner diameter of 0.5 mm, and, for typical choices of length for the linear extension portion of molybdenum coil 34*a*'", a length of 3.5 mm. Here, too, as with rod 41*a* above, the presence of sleeve 41*a*' will reduce the volume of frit glass 27*a* that is provided in the sealing region provided by resolidified frit 27*a*. The presence of sleeve 41*a*' also makes easier the wetting by frit glass 27*a* of the surfaces of structures about the gaps that are to be filled by frit glass 27*a* in the sealing region.

Although the present invention has been described with reference to preferred embodiments, workers skilled in the art will recognize that changes may be made in form and detail without departing from the spirit and scope of the invention.

The invention claimed is:

1. An arc discharge metal halide lamp for use in selected lighting fixtures, said lamp comprising:

a discharge chamber having visible light permeable walls of a selected shape bounding a discharge region through which walls a pair of electrode assemblies are supported with interior ends thereof positioned in said discharge region spaced apart from one another, and with said electrode assemblies each also extending through a corresponding capillary tube affixed to said walls to have exterior ends of said electrode assemblies positioned outside said arc discharge chamber; and at least one of said electrode assemblies comprising an electrode discharge structure located at said interior end of that said electrode assembly with said electrode discharge structure having a discharge region shaft extending into said capillary tube corresponding thereto, and further comprising said discharge region shaft extending outwardly in said corresponding capillary tube to be in electrical contact with an interconnection shaft having a portion thereof extending outside and past an exterior end of said corresponding capillary tube to provide said exterior end of that said electrode assembly; and a sealing cap provided outside and about said exterior end of said corresponding capillary tube, so as to cover an opening portion and an end portion of an exterior longitudinal surface of said corresponding capillary tube, about its circumference, and provided so as to be in direct contact with said interconnection shaft.

2. The lamp of claim 1 further comprising that remaining said electrode assembly having an electrode discharge structure located at said interior end of that remaining said electrode assembly with said electrode discharge structure having a discharge region shaft extending into said capillary tube corresponding thereto and further extending outwardly in said corresponding capillary tube to be in electrical contact with an interconnection shaft portion extending outside of said corresponding capillary tube to provide said exterior end of that remaining said electrode assembly, there being a sealing cap provided outside and about said exterior end of said corresponding capillary tube and in direct electrical contact with said interconnection shaft.

3. The lamp of claim 1 further comprising a helical coil is positioned at least in part about said discharge region shaft in said corresponding capillary tube.

4. The lamp of claim 3 wherein said helical coil is formed as an extended end coil so that an end portion thereof following a geometric curve other than a helix serves as said interconnection shaft.

5. The lamp of claim 4 wherein said helical coil follows a path of a variable pitch helix with a portion thereof interior to ends thereof.

6. The lamp of claim 4 further comprising a spatial volume occupying sleeve positioned about a portion of said interconnection shaft extending within said corresponding capillary tube.

7. The lamp of claim 4 wherein said helical coil is formed of a molybdenum wire having a selected diameter of 0.05 mm to 1.00 mm.

8. The lamp of claim 4 further comprising a spatial volume occupying rod positioned within said variable pitch helix portion of said helical coil interior to said ends of said helical coil.

9. The lamp of claim 3 wherein said discharge region shaft in said corresponding capillary tube extends past said exterior end thereof to be outside thereof to serve as said interconnection shaft portion.

10. The lamp of claim 3 wherein said interconnection shaft is substantially positioned outside of said corresponding capillary tube with said helical coil also extending in part outside of said corresponding capillary tube to be about said interconnection shaft.

11. The lamp of claim 3 further comprising an intermediate interconnection completing said electrical contact between said discharge region shaft and said interconnection shaft.

12. The lamp of claim 11 wherein said intermediate interconnection is formed of a selected one of a metal tube, a wrapped metal foil and a cermet rod.

13. The lamp of claim 1 further comprising a sealing frit positioned between at least a portion of said sealing cap and at least a portion of said corresponding capillary tube.

14. The lamp of claim 13 wherein said sealing frit is also positioned between at least a portion of said interconnection shaft extending within said corresponding capillary tube and at least a portion of said corresponding capillary tube.

15. The lamp of claim 13 wherein said sealing frit is also positioned between at least a portion of said interconnection shaft extending outside of said corresponding capillary tube and at least a portion of said sealing cap.

16. The lamp of claim 1 further comprising a spatial volume occupying structure positioned adjacent to a portion of said interconnection shaft extending within said corresponding capillary tube.

17. The lamp of claim 1 wherein said sealing cap is provided in direct contact with said interconnection shaft at a location adjacent a location that is of any contact therebetween.

18. The lamp of claim 17 wherein said direct contact between said sealing cap and said interconnection shaft portion is provided by a selected one of a weld therebetween and a crimp of said sealing cap to said interconnection shaft portion.

19. The lamp of claim 1 wherein said sealing cap extends across at least a portion of said exterior end of said corresponding capillary tube and at least a portion of a side thereof adjacent to said exterior end of said corresponding capillary tube.

20. A metal halide lamp comprising:

a discharge chamber including an arc discharge region;

a capillary tube, extending from said discharge chamber, having an opening portion at one end facing an interior space of said discharge chamber and another opening portion at the other end;

an electrode shaft inserted into said capillary tube, an electrode portion at the tip of an electrode shaft being a part of an electrode discharge structure located at said interior space of said discharge chamber;

a coil, coupled to said electrode shaft, being another portion of said electrode discharge structure;

a metal cap covering said another opening portion at the other end of said capillary tube, its perimeter, and its end portion, about its circumference of its exterior longitudinal surface; and a sealing frit provided between an inner wall of said capillary tube ranging at said another opening portion at the other end of said capillary tube and said electrode discharge structure.

* * * * *

UNITED STATES PATENT AND TRADEMARK OFFICE

CERTIFICATE OF CORRECTION

PATENT NO. : 7,164,232 B2
APPLICATION NO. : 10/883870
DATED : January 16, 2007
INVENTOR(S) : Nanu Brates et al.

It is certified that error appears in the above-identified patent and that said Letters Patent is hereby corrected as shown below:

Column 10, Line 34 , insert --absent-- before "of any contact therebetween"

Signed and Sealed this

Eighth Day of May, 2007

JON W. DUDAS
*Director of the United States Patent and Trademark Office*